US010011473B2

(12) United States Patent
Locke et al.

(10) Patent No.: US 10,011,473 B2
(45) Date of Patent: Jul. 3, 2018

(54) MILK JUG AND METHOD

(71) Applicants: Paul Locke, Pickering (CA); Antonio DiRoma, Maple (CA)

(72) Inventors: Paul Locke, Pickering (CA); Antonio DiRoma, Maple (CA)

( * ) Notice: Subject to any disclaimer, the term of this patent is extended or adjusted under 35 U.S.C. 154(b) by 0 days.

(21) Appl. No.: 15/338,784

(22) Filed: Oct. 31, 2016

(65) Prior Publication Data

US 2018/0118552 A1 May 3, 2018

(51) Int. Cl.

| | |
|---|---|
| ***B67B 7/00*** | (2006.01) |
| ***B67D 3/00*** | (2006.01) |
| ***B65D 77/06*** | (2006.01) |
| ***B65D 77/30*** | (2006.01) |
| ***B65D 85/80*** | (2006.01) |
| ***B65D 25/28*** | (2006.01) |
| ***B65D 25/42*** | (2006.01) |

(52) U.S. Cl.

CPC ..... *B67D 3/0029* (2013.01); *B65D 25/282* (2013.01); *B65D 25/42* (2013.01); *B65D 77/06* (2013.01); *B65D 77/30* (2013.01); *B65D 85/80* (2013.01); *B67D 3/0051* (2013.01); *B67D 3/0067* (2013.01)

(58) Field of Classification Search

CPC ..... B05C 5/0225
USPC ..... 222/1
See application file for complete search history.

(56) References Cited

U.S. PATENT DOCUMENTS

| | | | | |
|---|---|---|---|---|
| 4,265,372 | A * | 5/1981 | Wainberg | B05B 11/0043 222/82 |
| 4,561,560 | A * | 12/1985 | Lyon | B67B 7/28 220/278 |
| 5,141,134 | A * | 8/1992 | Machado | A47G 23/0258 222/105 |
| 5,454,487 | A * | 10/1995 | Vassiliou | A47G 19/18 222/158 |
| 5,806,719 | A * | 9/1998 | Witty | A47G 23/0258 222/105 |
| 7,182,220 | B2 * | 2/2007 | Raposo | A47G 23/0258 222/105 |
| 9,629,496 | B2 * | 4/2017 | Constantine | A47J 31/4489 |
| 2010/0108755 | A1 | 5/2010 | Fuerstenberg | |
| 2011/0109453 | A1 * | 5/2011 | Chen | G04F 1/005 340/540 |
| 2011/0122120 | A1 | 5/2011 | Feuilloley | |

* cited by examiner

*Primary Examiner* — Lori Baker
(74) *Attorney, Agent, or Firm* — Integrity Patent Group, PLC; Edwin Wold

(57) ABSTRACT

A milk jug includes a pitcher body, a handle, a blade retainer, and an expiration tag retainer. The milk jug is useful for containing and dispensing milk packaged in bags while retaining necessary accessories on the pitcher. The milk jug improves the utility and convenience of using milk bags by preventing the loss of the blade and expiration tag commonly used with milk bags.

18 Claims, 5 Drawing Sheets

MILK JUG AND METHOD

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of beverage containers of existing art and more specifically relates to a milk jug.

RELATED ART

A beverage container is a container designed to hold a fixed portion of liquid such as carbonated soft drinks, alcoholic beverages, fruit juices, teas, herbal teas, energy drinks, etc. Beverage containers are necessary for storing and dispensing edible fluids for everyday consumption, especially for refrigerated drinks. Reusable beverage containers may be necessary for beverages which are bought in bulk sizes and consumed in smaller servings. Additionally, many beverage containers contain means for dispensing beverages in individual portions more conveniently than commercial packaging. Containers may be constructed of glass, metal, ceramic, or plastic materials, and may be shaped in a variety of volumes and dispensing configurations. Certain beverages may necessitate specific features based on serving temperature, desired serving sizes, or other factors.

However, beverage containers have certain limitations. For example, users may experience difficulty in identifying beverages or obtaining beverage information about a fluid in a reusable container. Most beverage containers lack labeling information or customizable indicia for a variety of beverages. In particular, expiration dates may be unobtainable for a perishable drink. Additionally, users may experience difficulty in transferring fluids from a commercial package to a reusable beverage container. A suitable solution is desired.

Improved beverage containers are known in prior art. U.S. Pub. No. 2011/0109453 to Chia-Wen Chen relates to an apparatus for warning of an expiration date. The described apparatus for warning of an expiration date includes a casing, a processing unit located in the casing, and an attachment unit connected to the casing. U.S. Pub. No. 2011/0122120 to Guy Feuilloley relates to a container bearing an electronic label with a screen. The disclosure describes a container equipped with a body containing a product, on which is affixed a flexible electronic label adaptable to the contours of the container, the label comprising an electronic screen for displaying information relating to the product and visible to a user, a micro-controller linked to the screen for controlling the display of information on said screen and the updating of said information, and a power source linked to the micro-controller. U.S. Pub. No. 2010/0108755 to Zack Fuerstenberg et al describes a beverage holder apparatus including a chip unit attached to a beverage holder and adapted to communicate with a chip unit reader to perform a payment transaction to purchase the beverage.

SUMMARY OF THE INVENTION

In view of the foregoing disadvantages inherent in the known beverage container art, the present disclosure provides a novel milk jug. The general purpose of the present disclosure, which will be described subsequently in greater detail, is to provide a milk jug useful for containing a dispensable milk from a milk bag and for retaining an integral cutting blade and expiration tag retainer, as well as a method by which to dispense milk from a milk bag using the milk jug.

A milk jug is disclosed herein. The milk jug includes a pitcher body, a handle, a blade, and an expiration tag retainer. The milk bag pitcher is defined by a pitcher body having an inner cylindrical surface, an outer cylindrical surface, an upper edge, a base, and a spout including a U-shaped aperture; a handle attached to said pitcher body having a junction member and a grasping member; a blade embedded into said spout of said pitcher body having a blade flat and an edge; and an expiration tag retainer attached to said pitcher body having a tag enclosure, a tag retaining lip, and a tag insertion slot. Tag can be moved anywhere as desired. Knife can also be moved.

The handle is attached to the pitcher body for the purpose of providing a grasping means for lifting the milk jug. The milk jug is configured to store, support, and dispense milk from a milk bag; the pitcher body, the handle, the blade, and the expiration tag retainer being in functional combination. The components of the milk jug form a rigid unit containing an interior volume which is arranged to house a milk bag containing milk after the bag has been opened. The upper edge of the pitcher body is circular, being open for inserting the milk bag into the pitcher body. The inside surface tapered, which facilitates easy removal of a milk bag when full and also improves the flow of milk when tilted; the cylindrical body being of a larger diameter at the top and of a smaller diameter at the bottom.

The spout of the device is structured to support the corner of the milk bag when the pitcher is tilted to preventing spillage when dispensing milk through an open corner of the milk bag. The top of the pitcher is angled so that the spout projects upwardly from the top of the pitcher, forming a supporting region for the milk to flow through when the weight (mass) of the milk bag rests against the spout. This design prevents the amorphous milk bag from falling out of the pitcher, pressing the open corner in undesirable directions, or spilling milk into the front of the pitcher. The steep angle of the top of the pitcher makes the spout sufficiently long for supporting the milk bag when tilted excessively.

The U-shaped aperture in the spout forms a trough to provide a flow path for dispensed milk when the pitcher is tilted. The blade is embedded in the base of the U-shaped aperture of the spout at an angle, providing a mechanically advantaged cutting edge for easily cutting a corner from a milk bag. The sides of the spout form a protective guard around the blade and aid a user in referencing an appropriate location for the cut. The aperture also forms the outlet for milk to be dispensed from when the pitcher is tilted.

The base of the pitcher provides a standing structure to supporting said pitcher body on a flat surface while containing a milk bag, while expiration tag retainer is affixed to the outside surface of the pitcher body in a manner visible to a user. The retainer slidably receives the bread tag and positions a lateral face outwardly to notify a user of the expiration date of the milk contained within the pitcher. A lip prevents the tag from moving outwardly, and a slot on one vertical side of the rectangular retainer forms an opening to insert or remove the tag.

The junction member of the handle forms a rigid joint between the grasping member and the pitcher in such a way that the grasping member is approximately parallel to the pitcher body, forming a handgrip useful for tilting the milk jug.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a milk jug, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a beverage container and more particularly to a milk jug as used to improve the dispensing of milk from a milk bag.

Generally, the milk jug is useful for storing an opened milk bag and dispensing milk. The pitcher body is defined by a hollow, tapered cylindrical structure with a base at the bottom and an opening at the top for allowing a milk bag to be inserted. A handle extends outwardly from the pitcher body, providing a means for lifting and tilting the milk jug. The milk jug's integral blade is contained within the bottom of the open spout of the pitcher for safely and precisely cutting off the corner of a milk bag contained within the pitcher for creating an opening in the milk bag to pour milk from. The expiration tag retainer attached to the side of the pitcher accepts a bread clip or bread tag bearing expiration indicia from the milk bag's original packaging. The retainer surrounds the bread tag on three sides so that it may be slid in from one direction. A lip holds 3 edges of the face of the tag against the outside of the pitcher for retention. The face of the bread tag bearing an expiration date is visible between the boundaries of the retainer.

In using the disclosed milk jug, a user may place a milk bag into the pitcher and slide the corresponding bread tag into the expiration tag retainer displaying the expiration indicia outwardly in a visible manner. A user may then pull a corner of the milk bag through the slotted spout of the pitcher and pull downward, severing the corner in a controlled manner against the embedded blade. The milk is then ready to be poured through the opened corner of the milk bag and out the spout of the pitcher.

Figure 1:
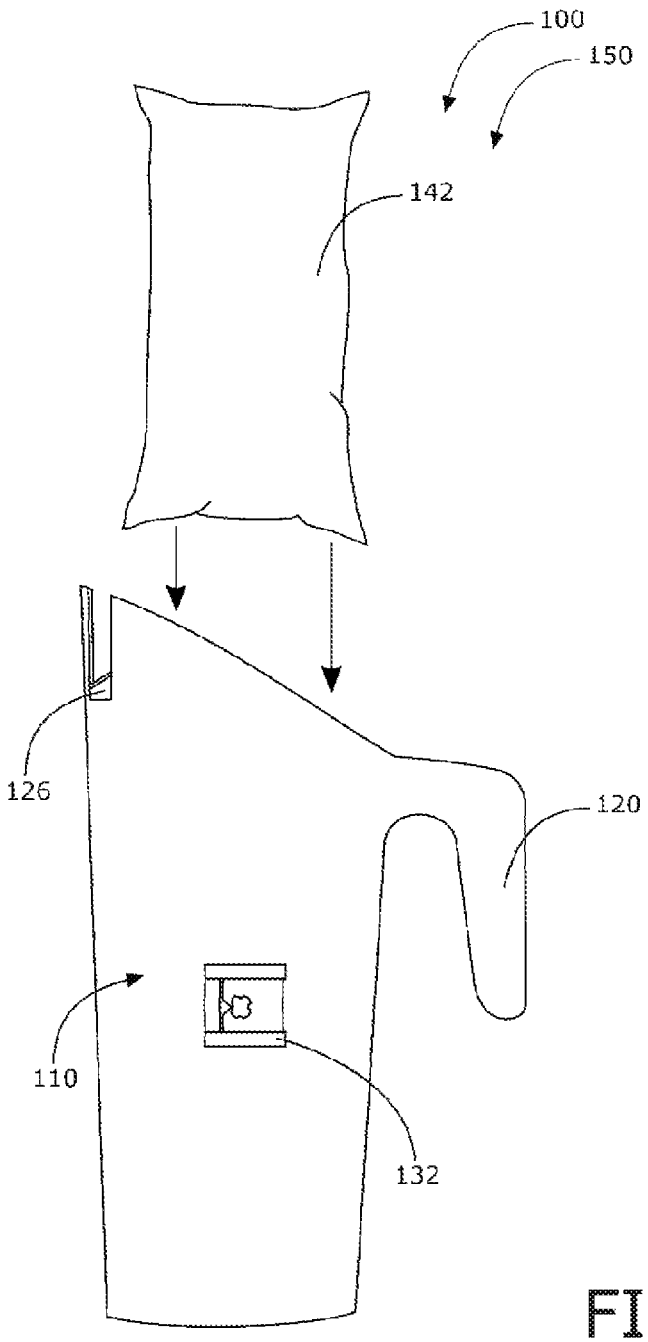
FIG. 1 is a front perspective view of the milk jug during an 'in-use' condition, according to an embodiment of the disclosure.

Referring now more specifically to the drawings by numerals of reference, there is shown in FIGS. 1-4, various views of milk jug 100. FIG. 1 shows a milk jug 100 during an 'in-use' condition 150, according to an embodiment of the present disclosure. Here, milk jug 100 may be beneficial for use by a user 140 dispensing milk from a milk bag 142. According to one embodiment, milk jug 100 may be arranged as a kit 105. In particular, milk jug 100 may further include a set of instructions 155. The instructions 155 may detail functional relationships in relation to the structure of milk jug 100 (such that milk jug 100 can be used, maintained, or the like, in a preferred manner).

Figure 2:
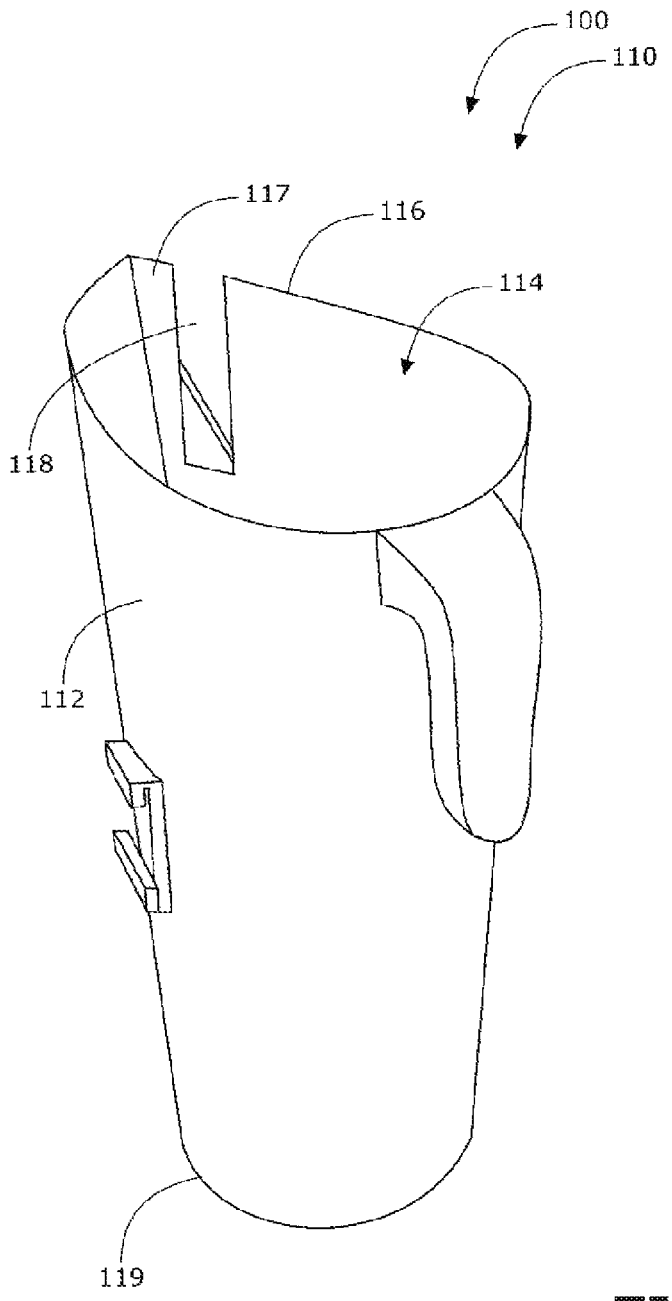
FIG. 2 is a profile view of the milk jug of FIG. 1, according to an embodiment of the present disclosure.

FIG. 2 shows the milk jug of FIG. 1, according to an embodiment of the present disclosure. As above, milk jug 100 may include pitcher body 110 having inner cylindrical surface 114, outer cylindrical surface 112, upper edge 116, base 119, and spout 117 including U-shaped aperture 118; handle 120 attached to pitcher body 110 including junction member 122 and grasping member 124; blade 126 embedded into spout 117 of pitcher body 110 having blade flat 128 and edge 130; and expiration tag retainer 132 attached to pitcher body 110 having tag enclosure 134, tag retaining lip 136, and tag insertion slot 138.

Handle 120 may be attached to pitcher body 110 for the purpose of providing a grasping means for lifting milk jug 100; wherein milk jug 100 is configured to store, support, and dispense milk from milk bag 142. Pitcher body 110, handle 120, blade 126, and expiration tag retainer 132 may be in functional combination. Pitcher body 110, handle 120, blade 126, and expiration tag retainer 132 comprise a rigid unit containing an interior volume. Pitcher body 110 may be structured and arranged to house milk bag 142 containing milk after milk bag 142 has been opened.

Upper edge 116 of pitcher body 110 may comprise a substantially circular opening for receiving milk bag 142 within pitcher body 110. Inner cylindrical surface 114 of pitcher body 110 may be sufficiently tapered to permit easy removal of milk bag 142 when full and to improve flow of milk from milk bag 142 when tilted, inner cylindrical surface 114 of pitcher body 110 being of a larger diameter at upper edge 116 of pitcher body 110, and of a smaller diameter at base 119 of pitcher body 110. Spout 117 of pitcher body 110 may be structured and arranged to sufficiently support corner of milk bag 142 when pitcher body 110 is tilted for purpose of preventing spillage when dispensing milk through a severed corner of milk bag 142. Upper edge 116 of pitcher body 110 may be pitched relative to base 119 of pitcher body 110; upper edge 116 of pitcher body 110 being highest relative to base 119 of pitcher body 110 above spout 117 of pitcher body 110, and lowest above junction member 122 of handle 120.

Spout 117 of pitcher body 110 may comprise a raised skirt extending upward at front of pitcher body 110 directly opposite of handle 120, having a sufficiently steep angle to support full height of milk bag 142 when pitcher body 110 is tilted. U-shaped aperture 118 of spout 117 of pitcher body 110 may comprise a trough in upper edge 116 of pitcher body 110 for the purpose of providing flow direction for dispensed milk when pitcher body 110 is tilted; U-shaped aperture 118 of spout 117 of pitcher body 110 being located near a peak of spout 117 of pitcher body 110. Base 119 of pitcher body 110 may provide a standing structure configured for supporting pitcher body 110 on a flat surface while containing milk bag 142. Junction member 122 of handle 120 may form a rigid joint between grasping member 124 of handle 120 and pitcher body 110 in such a way that grasping member 124 is approximately parallel to pitcher body 110 adapted to provide an ergonomic handgrip useful for tilting milk jug 142.

Figure 3:
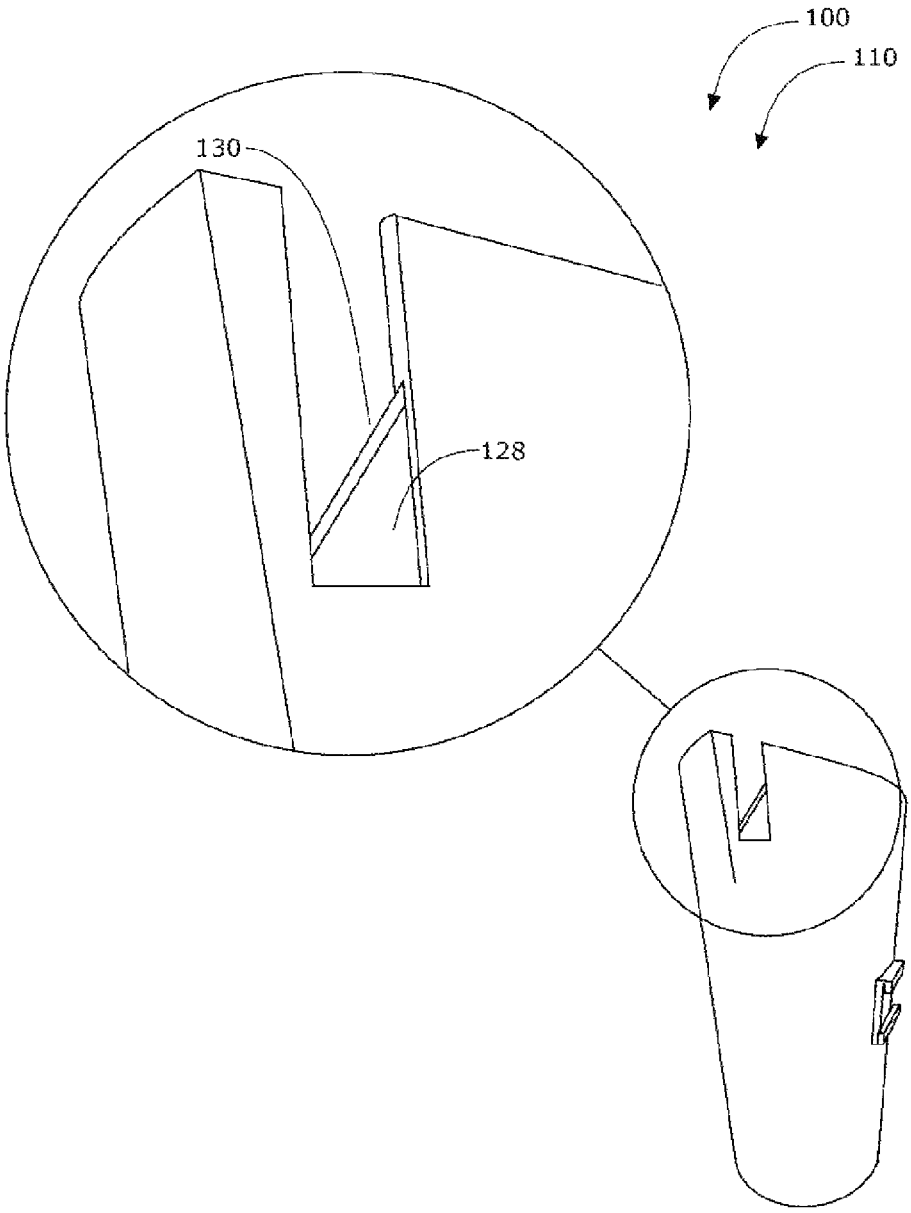
FIG. 3 is a perspective view of the blade of the milk jug of FIG. 1, according to an embodiment of the present disclosure.

FIG. 3 is a type view of the milk jug of FIG. 1, according to an embodiment of the present disclosure. Blade 126 may be embedded in U-shaped aperture 118 of spout 117 of pitcher body 110 at an obtuse angle relative to vertical wall of U-shaped aperture 118 of spout 117 of pitcher body 110 configured for providing a fixed cutting edge for severing a corner of milk bag 142 resting in pitcher body 110. U-shaped aperture 118 of spout 117 of pitcher body 110 may form a fixed outlet configured for dispensing milk from a severed corner of milk bag 142 when pitcher body 110 is tilted.

Figure 4:
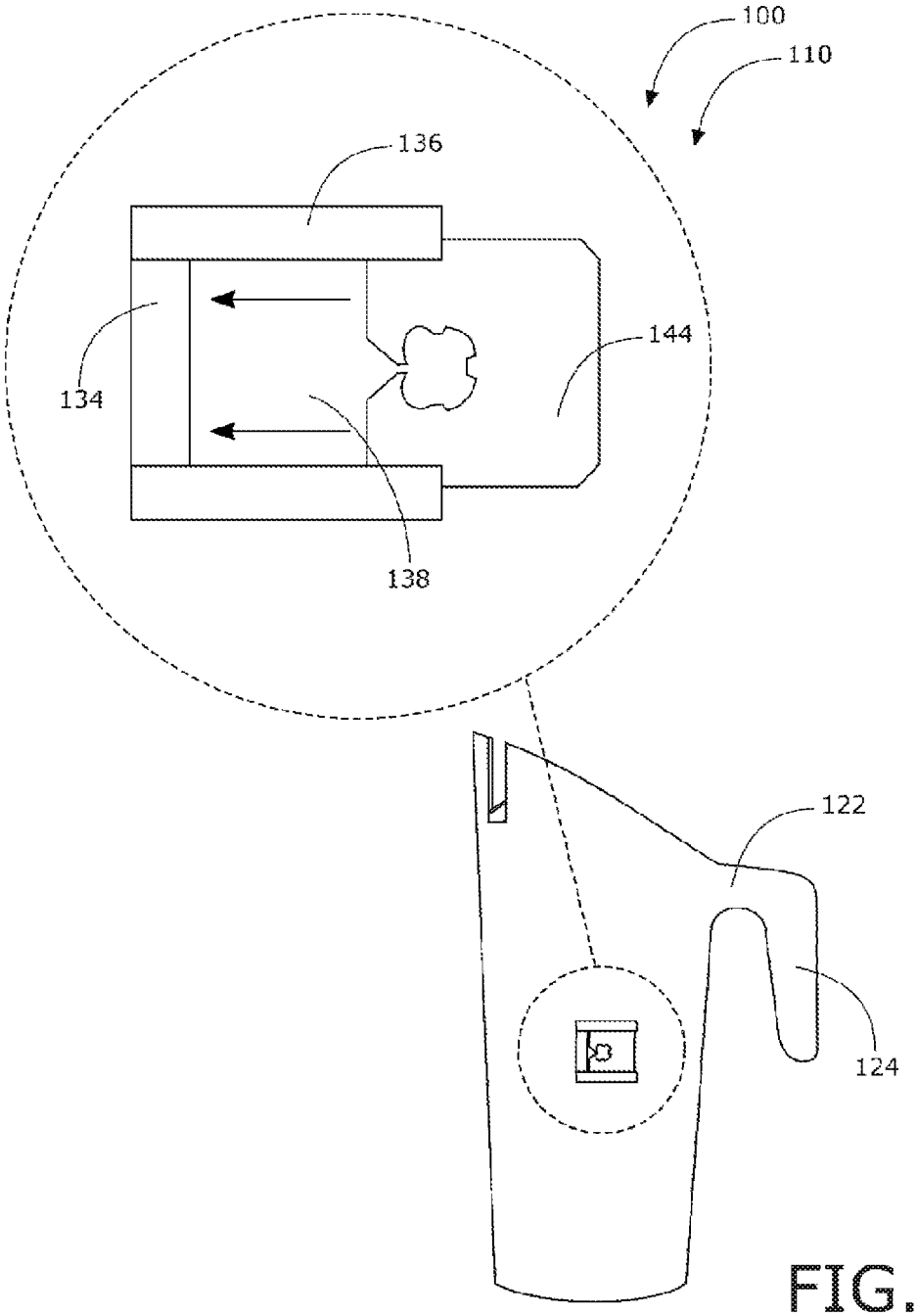
FIG. 4 is a perspective view of the expiration tag retainer of the milk jug of FIG. 1, according to an embodiment of the present disclosure.

FIG. 4 is a type view of the milk jug of FIG. 1, according to an embodiment of the present disclosure. Expiration tag retainer 132 may be affixed to outer cylindrical surface 112 of pitcher body 110 in a location visible to user 140. Expiration tag retainer 132 may be structured and arranged to receive and display a bread tag from milk bag 142 bearing expiration date indicia for the purpose of notifying user 140 of expiration date of milk bag 142. Tag enclosure 134 of expiration tag retainer 132, tag retaining lip 136 of expiration tag retainer 132, tag insertion slot 138 of expiration tag retainer 132, and pitcher body 110 may enclose an inner volume having an open face opposite of pitcher body 110 for displaying indicia, and having a gap on one side of expiration tag retainer 132 comprising tag insertion slot 138 for slidably receiving bread tag 144.

Figure 5:
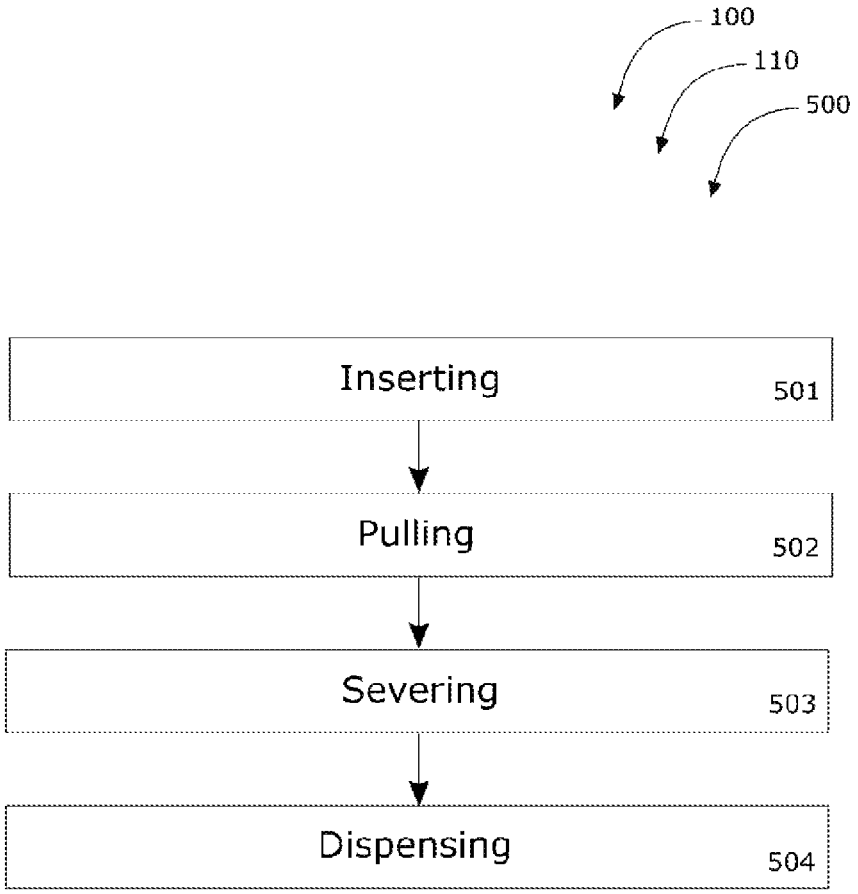
FIG. 5 is a flow diagram illustrating a method of use of serving milk, according to an embodiment of the present disclosure.

FIG. 5 is a flow diagram illustrating a method 500 for dispensing of milk from a milk bag, according to an embodiment of the present disclosure. In particular, the method 500 for dispensing of milk from a milk bag may include one or more components or features of milk jug 100 as described above. As illustrated, the method for use 500 may include the steps of: step one 501, inserting a milk bag; step two 502, pulling a corner of the milk bag through the spout; step three 503, severing the corner of the milk bag on the blade; step three 504 dispensing milk from the milk bag by tilting the pitcher.

It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for dispensing of milk from a milk bag (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A milk jug, the milk jug comprising:

a) a pitcher body having an inner cylindrical surface, an outer cylindrical surface, an upper edge, a base, and a spout including a U-shaped aperture and a raised skirt;

b) a handle attached to said pitcher body having a junction member and a grasping member;

c) a blade embedded into said spout of said pitcher body having a blade flat and an edge; and d) an expiration tag retainer attached to said pitcher body having a tag enclosure, a tag retaining lip, and a tag insertion slot;

e) wherein the handle is attached to the pitcher body for the purpose of providing a grasping means for lifting the milk jug;

f) wherein said spout of said pitcher body comprises said raised skirt extending upward at the front of said pitcher body directly opposite of said handle, having a sufficiently steep angle to support the full height of a milk bag when said pitcher body is tilted;

g) wherein said milk jug is configured to store, support, and dispense milk from said milk bag; and h) wherein said pitcher body, said handle, said blade, and said expiration tag retainer are in functional combination.

2. The milk jug of claim 1, wherein said pitcher body, said handle, said blade, and said expiration tag retainer comprise a rigid unit containing an interior volume.

3. The milk jug of claim 1, wherein said pitcher body is structured and arranged to house said milk bag containing milk after said milk bag has been opened.

4. The milk jug of claim 1, wherein said upper edge of said pitcher body comprises a substantially circular opening for receiving said milk bag within said pitcher body.

5. The milk jug of claim 1, wherein said inner surface of said pitcher body is sufficiently tapered to permit easy removal of said milk bag when full and to improve flow of milk from said milk bag when tilted, said inner surface of said pitcher body being of a larger diameter at said upper edge of said pitcher body, and of a smaller diameter at said base of said pitcher body.

6. The milk jug of claim 1, wherein said spout of said pitcher body is structured and arranged to sufficiently support the corner of said milk bag when said pitcher body is tilted for the purpose of preventing spillage when dispensing milk through a severed corner of said milk bag.

7. The milk jug of claim 1, wherein said upper edge of said pitcher body is pitched relative to said base of said pitcher body, said upper edge of said pitcher body being highest relative to said base of said pitcher body above said spout of said pitcher body, and lowest above said junction member of said handle.

8. The milk jug of claim 1, wherein said U-shaped aperture of said spout of said pitcher body comprises a trough in said upper edge of said pitcher body for the purpose of providing flow direction for dispensed milk when said pitcher body is tilted, said U-shaped aperture of said spout of said pitcher body being located near a peak of said spout of said pitcher body.

9. A milk jug, the milk jug comprising:

a) a pitcher body having an inner cylindrical surface, an outer cylindrical surface, an upper edge, a base, and a spout including a U-shaped aperture;

b) a handle attached to said pitcher body having a junction member and a grasping member;

c) a blade embedded into said spout of said pitcher body having a blade flat and an edge; and d) an expiration tag retainer attached to said pitcher body having a tag enclosure, a tag retaining lip, and a tag insertion slot;

e) wherein the handle is attached to the pitcher body for the purpose of providing a grasping means for lifting the milk jug;

f) wherein said blade is embedded in said U-shaped aperture of said spout of said pitcher body at an obtuse angle relative to the vertical wall of said U-shaped aperture of said spout of said pitcher body configured for providing a fixed cutting edge for severing a corner of said milk bag resting in said pitcher body;

g) wherein said milk jug is configured to store, support, and dispense milk from said milk bag; and h) wherein said pitcher body, said handle, said blade, and said expiration tag retainer are in functional combination.

10. The milk jug of claim 1, wherein said U-shaped aperture of said spout of said pitcher body forms a fixed outlet configured for dispensing milk from a severed corner of said milk bag when said pitcher body is tilted.

11. The milk jug of claim 1, wherein said base of said pitcher body provides a standing structure configured for supporting said pitcher body on a flat surface while containing said milk bag.

12. The milk jug of claim 1, wherein said expiration tag retainer is affixed to said outer cylindrical surface of said pitcher body in a location visible to a user.

13. The milk jug of claim 1, wherein said expiration tag retainer is structured and arranged to receive and display a bread tag from said milk bag bearing expiration date indicia for the purpose of notifying a user of said milk bag's expiration date.

14. A milk jug, the milk jug comprising:

a) a pitcher body having an inner cylindrical surface, an outer cylindrical surface, an upper edge, a base, and a spout including a U-shaped aperture;

b) a handle attached to said pitcher body having a junction member and a grasping member;

c) a blade embedded into said spout of said pitcher body having a blade flat and an edge; and d) an expiration tag retainer attached to said pitcher body having a tag enclosure, a tag retaining lip, and a tag insertion slot;

e) wherein the handle is attached to the pitcher body for the purpose of providing a grasping means for lifting the milk jug;

f) wherein said tag enclosure of said expiration tag retainer, said tag retaining lip of said expiration tag retainer, said tag insertion slot of said expiration tag retainer, and said pitcher body enclose an inner volume having an open face opposite of said pitcher body for displaying indicia, and having a gap on one side of said expiration tag retainer comprising said tag insertion slot for slidably receiving said bread tag;

g) wherein said milk jug is configured to store, support, and dispense milk from said milk bag; and h) wherein said pitcher body, said handle, said blade, and said expiration tag retainer are in functional combination.

15. The milk jug of claim 1, wherein said junction member of said handle forms a rigid joint between said grasping member of said handle and said pitcher body in such a way that said grasping member is approximately parallel to said pitcher body adapted to provide an ergonomic handgrip useful for tilting said milk jug.

16. A milk bag pitcher, the milk bag pitcher comprising:

a pitcher body having an inner cylindrical surface, an outer cylindrical surface, an upper edge, a base, and a spout including a U-shaped aperture;

a handle attached to said pitcher body having a junction member and a grasping member;

a blade embedded into said spout of said pitcher body having a blade flat and an edge; and an expiration tag retainer attached to said pitcher body having a tag enclosure, a tag retaining lip, and a tag insertion slot;

wherein the handle is attached to the pitcher body for the purpose of providing a grasping means for lifting the milk jug;

wherein said milk jug is configured to store, support, and dispense milk from a milk bag;

wherein said pitcher body, said handle, said blade, and said expiration tag retainer are in functional combination;

wherein said pitcher body, said handle, said blade, and said expiration tag retainer comprise a rigid unit containing an interior volume;

wherein said pitcher body is structured and arranged to house said milk bag containing milk after said milk bag has been opened;

wherein said upper edge of said pitcher body comprises a substantially circular opening for receiving said milk bag within said pitcher body;

wherein said inner surface of said pitcher body is sufficiently tapered to permit easy removal of said milk bag when full and to improve flow of milk from said milk bag when tilted, said inner surface of said pitcher body being of a larger diameter at said upper edge of said pitcher body, and of a smaller diameter at said base of said pitcher body;

wherein said spout of said pitcher body is structured and arranged to sufficiently support the corner of said milk bag when said pitcher body is tilted for preventing spillage when dispensing milk through a severed corner of said milk bag;

wherein said upper edge of said pitcher body is pitched relative to said base of said pitcher body, said upper edge of said pitcher body being highest relative to said base of said pitcher body above said spout of said pitcher body, and lowest above said junction member of said handle;

wherein said spout of said pitcher body comprises a raised skirt extending upward at the front of said pitcher body directly opposite of said handle, having a sufficiently steep angle to support the full height of said milk bag when said pitcher body is tilted;

wherein said U-shaped aperture of said spout of said pitcher body comprises a trough in said upper edge of said pitcher body for the purpose of providing flow direction for dispensed milk when said pitcher body is tilted, said U-shaped aperture of said spout of said pitcher body being located near a peak of said spout of said pitcher body;

wherein said blade is embedded in said U-shaped aperture of said spout of said pitcher body at an obtuse angle relative to the vertical wall of said U-shaped aperture of said spout of said pitcher body configured for providing a fixed cutting edge for severing a corner of said milk bag resting in said pitcher body;

wherein said U-shaped aperture of said spout of said pitcher body forms a fixed outlet configured for dispensing milk from a severed corner of said milk bag when said pitcher body is tilted;

wherein said base of said pitcher body provides a standing structure configured for supporting said pitcher body on a flat surface while containing said milk bag;

wherein said expiration tag retainer is affixed to said outer cylindrical surface of said pitcher body in a location visible to a user;

wherein said expiration tag retainer is structured and arranged to receive and display a bread tag from said milk bag bearing expiration date indicia for the purpose of notifying a user of said milk bag's expiration date;

wherein said tag enclosure of said expiration tag retainer, said tag retaining lip of said expiration tag retainer, said tag insertion slot of said expiration tag retainer, and said pitcher body enclose an inner volume having an open face opposite of said pitcher body for displaying indicia, and having a gap on one side of said expiration tag retainer comprising said tag insertion slot for slidably receiving said bread tag;

wherein said junction member of said handle forms a rigid joint between said grasping member of said handle and said pitcher body in such a way that said grasping member is approximately parallel to said pitcher body adapted to provide an ergonomic handgrip useful for tilting said milk jug.

17. The milk jug of claim 16, further comprising set of instructions; and wherein the milk jug is arranged as a kit.

18. A method of serving milk, the method using the milk jug of claim 16 and comprising the steps of: inserting a milk bag into a said pitcher body, pulling a corner of said milk bag through a spout, severing said corner of said milk bag on ft said blade, and dispensing milk from said milk bag by tilting said pitcher body.

* * * * *